US007040582B2

(12) United States Patent
Rosler

(10) Patent No.: US 7,040,582 B2
(45) Date of Patent: May 9, 2006

(54) HANGER FOR PLASTIC BAGS AND POUCHES

(76) Inventor: Peter Rosler, Ifenweg 3, Wangen (DE), D-88239

( * ) Notice: Subject to any disclaimer, the term of this patent is extended or adjusted under 35 U.S.C. 154(b) by 342 days.

(21) Appl. No.: 09/751,885

(22) Filed: Dec. 29, 2000

(65) Prior Publication Data

US 2002/0060276 A1 May 23, 2002

(30) Foreign Application Priority Data

Nov. 17, 2000 (DE) ..... 200 19 536 U

(51) Int. Cl.
*B65B 67/12* (2006.01)

(52) U.S. Cl. ..... 248/95; 248/101

(58) Field of Classification Search ..... 248/95, 248/100, 684, 686, 690, 914, 682, 689, 101; 206/554, 466

See application file for complete search history.

(56) References Cited

U.S. PATENT DOCUMENTS

| | | | | | |
|---|---|---|---|---|---|
| 285,908 | A | * | 10/1883 | Ludington | 248/101 |
| 2,710,732 | A | * | 6/1955 | Peters | 248/100 |
| 3,126,094 | A | * | 3/1964 | Arnold et al. | 206/57 |
| 3,285,407 | A | * | 11/1966 | Abramson | 206/57 |
| 3,707,271 | A | * | 12/1972 | Sanchez et al. | 248/101 |
| 3,755,859 | A | * | 9/1973 | Solari | 24/84 R |
| 3,790,045 | A | * | 2/1974 | Rigel et al. | 223/90 |
| 4,634,005 | A | * | 1/1987 | Kulzer et al. | 206/477 |
| 4,983,047 | A | * | 1/1991 | Netto | 383/5 |
| 5,088,667 | A | * | 2/1992 | Olson | 248/101 |
| 5,501,378 | A | * | 3/1996 | Kolton et al. | 223/87 |
| 5,524,762 | A | * | 6/1996 | Shafran et al. | 206/554 |
| 5,620,118 | A | * | 4/1997 | Kolton et al. | 223/85 |
| 5,713,467 | A | * | 2/1998 | Kao | 206/349 |
| 5,957,344 | A | * | 9/1999 | Kolton | 223/85 |
| 5,988,381 | A | * | 11/1999 | Ling | 206/349 |

FOREIGN PATENT DOCUMENTS

| | | | | |
|---|---|---|---|---|
| EP | 0 540 810 A1 | | 5/1992 | |
| FR | 2579174 | * | 9/1986 | 206/3 |

* cited by examiner

*Primary Examiner*—Leslie A. Braun
*Assistant Examiner*—A. Joseph Wujciak
(74) *Attorney, Agent, or Firm*—Frederick L. Tolhurst, Esq; Cohen & Grigsby, P.C.

(57) ABSTRACT

A hanger for hanging bags wherein a card body (2) cooperates with a holding strip (11) that is connected to the card body by a film hinge (10) to define a gap between the card body and the holding strip. A means for latching the holding strip (11) to the card body (2) includes a first mechanism (9) for latching the holding strip to a fastening surface (7) of the card body (2) or a second mechanism for latching the holding strip to a side edge (14) of the card body (2).

26 Claims, 4 Drawing Sheets

HANGER FOR PLASTIC BAGS AND POUCHES

Figure 1:
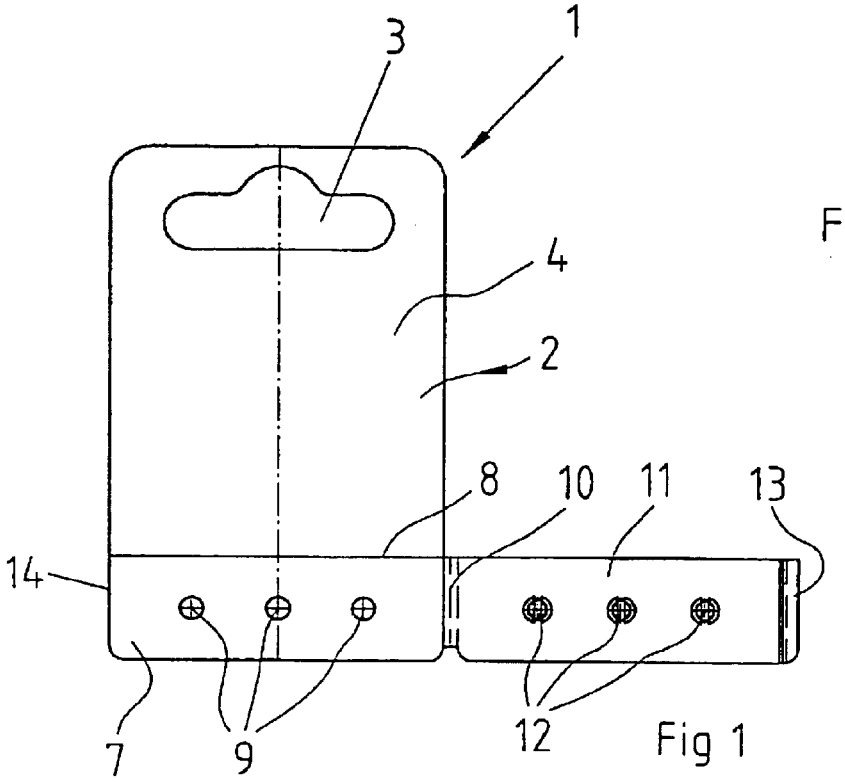

The invention concerns a hanger for plastic bags according to the introductory part of patent claim 1. Hangers of this kind are used for the display of merchandise which is attached to a hanger.

A comparable hanger for folding objects to be displayed has become known with the subject of EP 540 810 A1. With this hanger, on a flat card body two mutually opposed holding strips are arranged in each case at the side edges of the card body so as to be pivotable via film hinges. The holding strips are latchable to each other and so form a clamping gap between the card body and the respective holding strip. A folding object to be displayed can now be wedged in this clamping gap and thus held and displayed.

A hanger of this kind is suitable only for folding objects to be displayed, because the objects can only be wedged in the clamping gap between the card body and the holding strips which are latchable to each other. A hanger of this kind is however not suitable for the support of plastic bags in which is packed the merchandise to be displayed.

It is therefore the object of the invention to develop a hanger of the kind mentioned hereinbefore in such a way that it is suitable for the support of plastic bags.

To achieve the set object, the hanger disclosed herein includes a card body that has at least one recess. The card body has one side with a portion of that side defining a fastening surface. At least one holding strip cooperates with the card body to define a gap between the holding strip and the card body at times when the holding strip is located adjacent to the card body. At least one film hinge corresponds to a respective one of each of said holding strips and pivotally connects the corresponding holding strip to the one side of said card body. Each of the holding strips cooperates with the card body at times when the holding strip is pivoted adjacent to the card body to define a gap between the holding strip and the card body such that the bag is maintained in the gap between the holding strip and the fastening surface of the card body.

A substantial characteristic of the invention is that a plastic bag or a plastic pouch in which is packed the object to be packed and displayed, is held with the upper edge in the gap between at least one holding strip and a fastening surface arranged on the card body.

The invention therefore provides, by contrast with EP 540 810 A1, that a plastic bag is attached with an upper edge in the gap between at least one holding strip and the card body. By this means there is the advantage that the objects to be displayed now no longer have to be wedged in folded form in the holding strip, but that instead a plastic bag is wedged in the clamping gap between the holding strip and the card body, in which in turn are packed the objects to be displayed.

With this type of display of merchandise there are substantial advantages which are described in more detail with the aid of a practical example.

It is known that plastic bags can be made of a relatively thin PE or PP plastic material. This type of packing is used for lightweight tools and accessories, since these bags are not very portable. These bags are preferably stapled by their upper edge to a cardboard strip with staples.

Due to the type of attachment of the bag to the card body used, there is the disadvantage that the bag can now be removed from the card body by tearing off and, after tearing off, can be opened only with difficulty due to the tear edges formed. Reclosure is moreover no longer possible.

Previously it was further known that for example heavier tools or other heavier objects can be packed in plastic bags. The plastic bag is preferably made of a thicker PVC or PP material which is tear-resistant. These bags have on the upper side a hanging bag with a recess formed therein.

As a rule plastic bags of this kind are printed and bear on their surface the labelling of the merchandise, certain merchandise details and for example also the price.

It is disadvantageous that in the case of heavy merchandise the hanging bag is unattractively deformed.

This type of merchandise display has serious drawbacks. The printed plastic bag must always be coordinated with the merchandise contained in it. This requires keeping relatively large stocks, on the one hand of plastic bags and on the other hand of merchandise specially to be packed in the respective type of plastic bag. Each item of merchandise must be precisely coordinated with the plastic bag provided and printed therefor.

Here begins the invention, which proposes preferably using an unprinted plastic bag, but which is held in the clamping gap with holding strips arranged on the card body and the card body.

If unprinted plastic bags are used, first of all there is the advantage that the bag can be kept completely neutral, and the object contained in it is not concealed by print on the bag, advertising and the like. It is therefore readily visible.

According to the invention the card body used with the plastic bag is now designed with a large area, so that appropriate indications of the type and quality of the merchandise, its use and its price can be given on the front, and if occasion arises also on the back. Labelling of the merchandise is effected in this case by means of rapidly printable labels on the card body.

Hence there is the substantial advantage that stockkeeping is now substantially less because for any objects to be packed there are used neutral plastic bags in which is contained the object to be packed, and that actual coordination between the object and the information belonging to the object is effected by print on the card body itself.

This type of packing technology presupposes that the plastic bag is attached to the card body releasably, or releasably only by destruction.

For a releasable or non-removable connection of the plastic bag to the card body of this kind, there are a number of embodiments which are all claimed individually on their own and also in combination with each other as essential to the invention.

In one simple embodiment it is provided that the holding strip is latchable by latch means to the fastening surface on the card body.

In this case one or more holding strips can be linked to the card body on one side in each case by a horizontal or vertical pivot axis, the pivot axis being preferably formed by a film hinge between the holding strip and the card body. This requires that the card body and the holding strip are connected to each other integrally in material, and preferably made of a plastic material or a multi-layer plastic material.

With this choice of material, when making the card body in combination with the holding strip attached thereto the film hinge can very easily be formed as well.

Opposite the film hinge on the holding strips are arranged corresponding latch means with which they are releasably or permanently latchable to the card body.

Such latch means can be constructed differently. In one preferred embodiment it is a latch strip which is arranged at the free pivotable end of the holding strip and which encompasses the card body on the narrow side and in this way is latchable to the latter.

In addition to latch means arranged at the end of the holding strip, however, there may also be latch means which are arranged on the surface of the holding strip and which cooperate with associated counter latch means on the card body.

It is moreover irrelevant for the success of the instruction according to the invention whether one or more holding strips are arranged on the card body, and whether they are attached to the card body by a horizontal or vertical axis by respective film hinges.

Naturally the film hinges can also be omitted and the holding strips can be latchable to the card body as separate components.

Another embodiment of the latch means described consists for example in that on the holding strip are arranged one or more latch pins which cooperate with corresponding recesses in the card body.

Naturally the kinematic reversal is also claimed as essential to the invention for all the latch means described, i.e., referred to the embodiment described here, also on the card body may be arranged the latch pins which cooperate with associated latch recesses in the holding strip.

In addition to such latch means there are of course also other latch means such as for example hook and pile-type fastenings, press stud fastenings and the like. Instead of the releasable or fixed latch means, non-releasable connections such as friction weld joints, adhesive joints and the like which must be destroyed on opening are also claimed.

Since therefore preferably the plastic bag is attached to the card body with the aid of holding strips provided with latch means, in the simplest form it is provided that the bag is easily pulled through the holding strip and, if it comprises an upper closure bead, protrudes with this closure bead upwardly from the holding strip, so that its flat portion is easily clamped by the clamping gap which is formed by the card body and the holding strip, and the bead-like thicker portion at the upper edge of the bag protrudes upwardly from the holding strip and there rests on the holding strip.

The clamping gap formed by the holding strip and card body is therefore narrower than the edge closure bead of the plastic bag, so that the latter is held reliably in the holding strip.

In another embodiment of the invention it is provided that in the upper region of the bag are provided corresponding recesses which cooperate with associated pins on the holding strip of the card body and through which these pins extend. The holding strip in this embodiment has two different latch means, namely firstly the edge latch means, formed from a latch strip attached to the holding strip at the end and joined to the latter integrally, and secondly in addition latch pins which are joined integrally to the holding strip and which pass through the recesses in the plastic bag, which thus hold the plastic bag and in the closed state are latched in associated recesses in the card body. The latch means can, according to the requirements of the application, be easy to open or, for reasons of theft, be fixed and releasable only by destruction.

Instead of several spaced-apart latch pins, however, a single latch knob can be provided on the inside of the holding strip, which engages in an associated elongate and approximately slot-like latch recess in the card body.

This elongate and approximately horizontally oriented latch knob then passes through a correspondingly adapted recess in the upper region of the bag, so that the latter is in turn held by this additional support means in the clamping gap between the holding strip and the card body.

One particular advantage with the invention results from the possibility of using a guarantee label. If the latching of the holding strip to the card body is made flush with the other surfaces of the hanger, a guarantee label can be stuck over the whole front surface of the hanger and over the holding strip latched to the hanger, covering the holding strip.

On opening the holding strip the label must be damaged, so that in the sales room it can be seen very quickly if the customer has undesirably joined a plastic bag with different contents to a hanger.

It has already been mentioned above that the invention has the object of not only holding plastic bags with a smooth edge, but additionally plastic bags with a closure bead formed at the edge.

For this purpose the invention provides that through the clamping surface between the holding strip and the card body passes a horizontal transverse groove in which is laid the bead-like closure edge of the plastic bag to be held.

This results in improved support of the plastic bag in the clamping gap, because added to support in the clamping gap there is support of the closure bead in the transverse groove.

In this embodiment too it may be provided that the holding strip passes with additional latch means and/or holding means through the plastic bag.

In particular it is preferred if on the inside of the holding strip are arranged corresponding mandrels opposite which associated recesses are located in the card body.

The plastic bag to be held is laid with its closure bead in the transverse groove in the region of the clamping gap while the holding strip is open; the latter is then closed, so that then the mandrels arranged on the holding strip pass through the plastic bag and enter the associated recesses in the card body and are fixed there.

Naturally, the mandrels described can also be supplemented by additional latch means between holding strip and card body, which likewise pass through associated recesses in the plastic bag and hold them in addition.

But in a simplified embodiment these mandrels can also be omitted and it may simply be provided that the closure bead of the plastic bag is held in an associated transverse groove in the clamping gap between card body and holding strip.

It is once again pointed out that all the holding means and latch means described above are interchangeable with each other and can be arranged on a hanger individually on their own and also in combination with each other.

The subject of the present invention follows not only from the subjects of the individual patent claims, but also from the combination of the individual patent claims with each other.

All the details and characteristics disclosed in the documents including the abstract, in particular the three-dimensional construction shown in the drawings, are claimed as essential to the invention as far as they are novel individually or in combination compared with the state of the art.

Below, the invention is described in more detail with the aid of drawings showing several embodiments. Here, further characteristics essential to the invention and advantages of the invention are apparent from the drawings and the description thereof.

They show:

FIG. 1: View of the hanger with the holding strip open.

Figure 2:
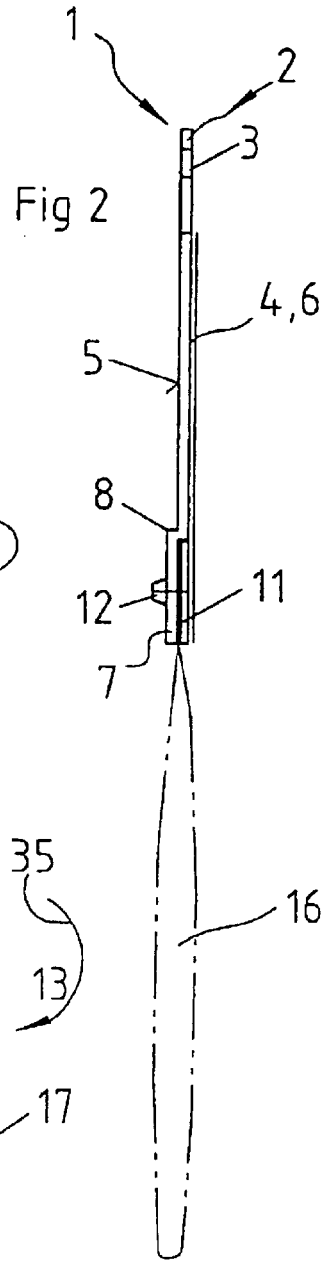

FIG. 2: The side view of the hanger with the holding strip closed in the state ready for packing.

Figure 3:
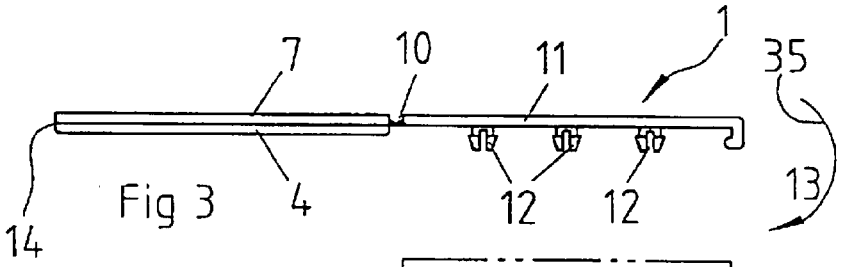

FIG. 3: The end view of the arrangement according to FIG. 1.

Figure 4:
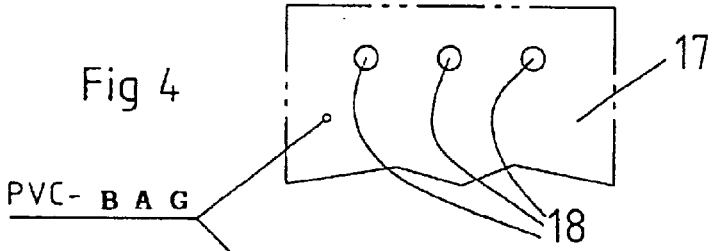

FIG. 4: A first embodiment of the construction of the top portion and opening region of the plastic bag.

Figure 5:
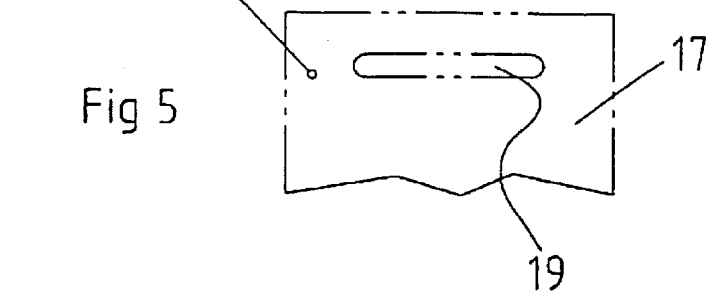

FIG. 5: A second embodiment of the construction of the top portion of the plastic bag.

Figure 6:
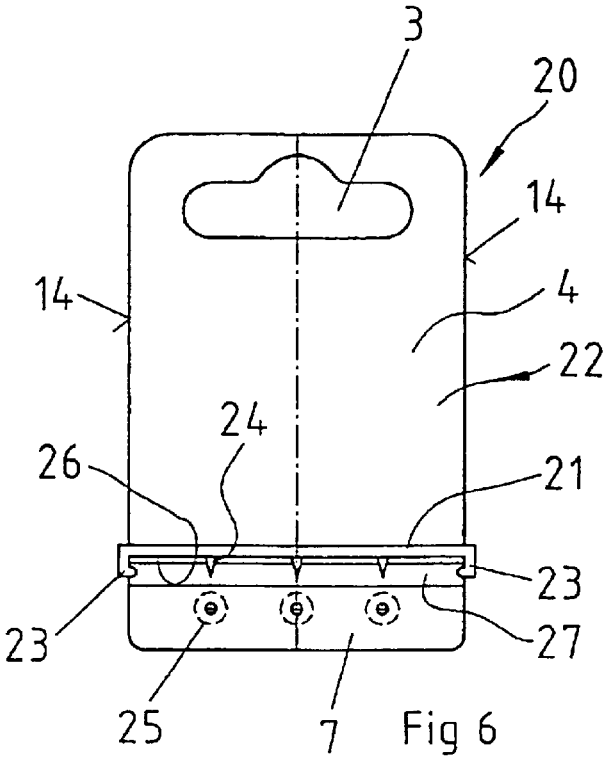

FIG. 6: An embodiment of a hanger modified from FIG. 1.

Figure 7:
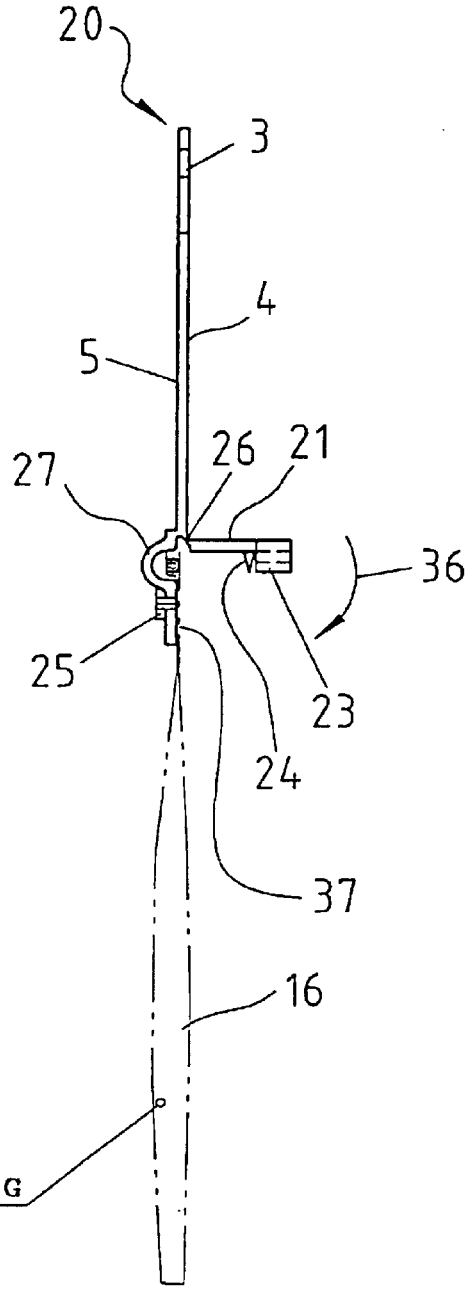

FIG. 7: The hanger according to FIG. 6 in a side view.

Figure 8:
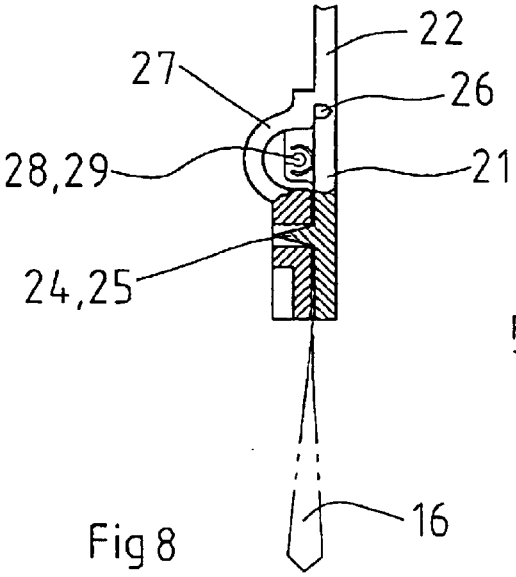

FIG. 8: Section through the closure region of the hanger.

Figure 9:
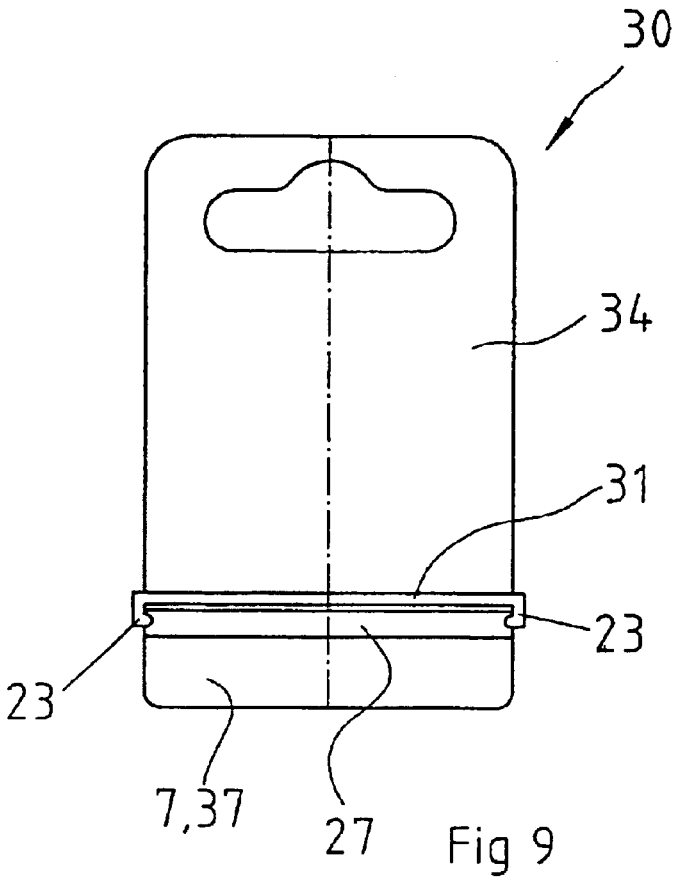

FIG. 9: A third embodiment of a hanger.

Figure 10:
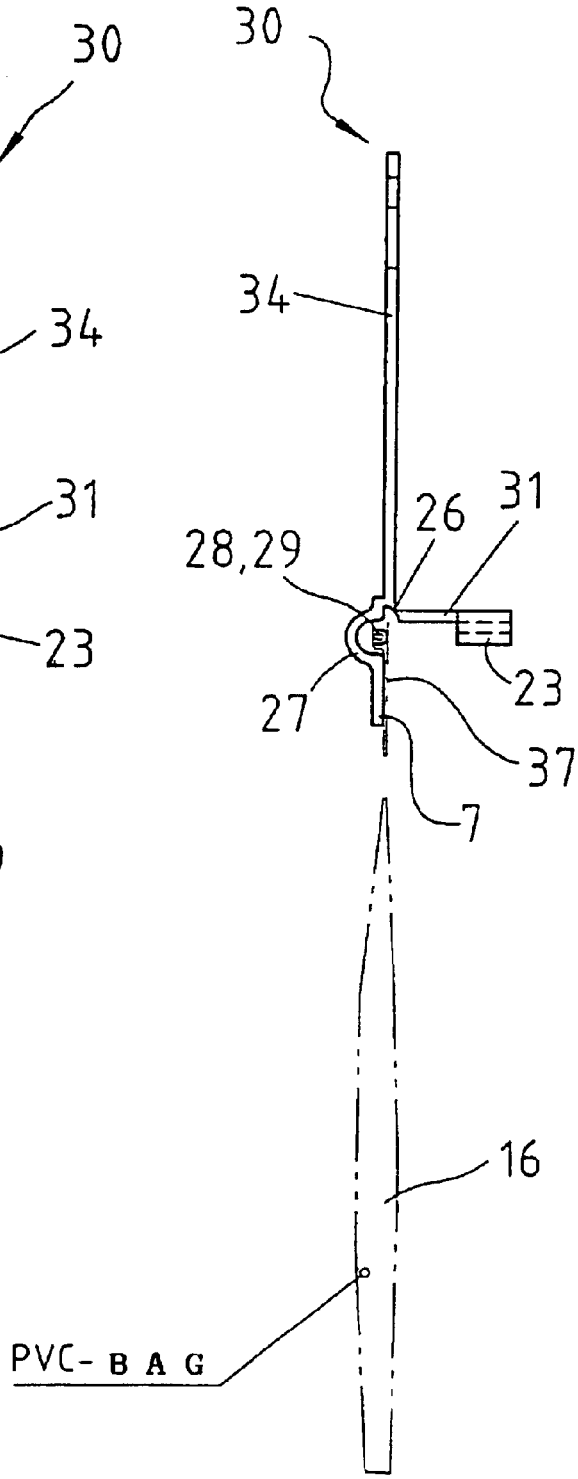

FIG. 10: The hanger according to FIG. 9 in a side view.

Figure 11:
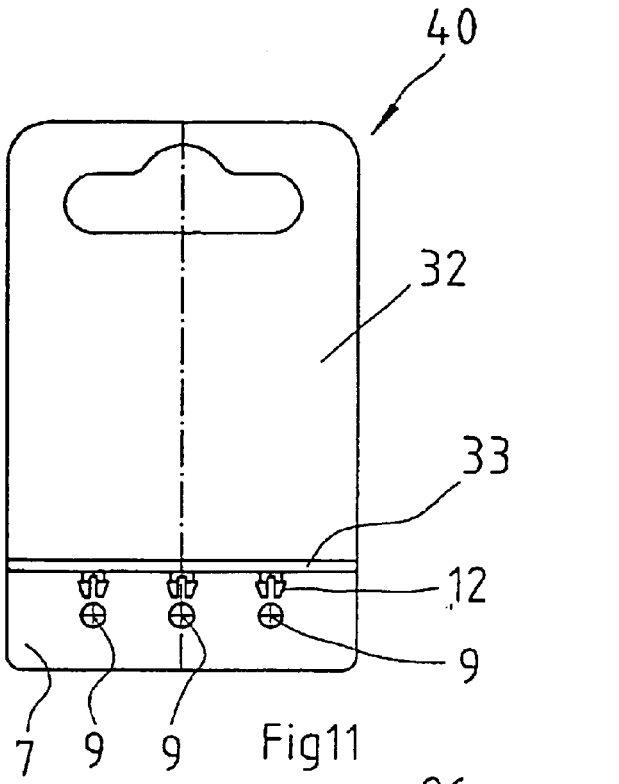

FIG. 11: A fourth embodiment of a hanger.

Figure 12:
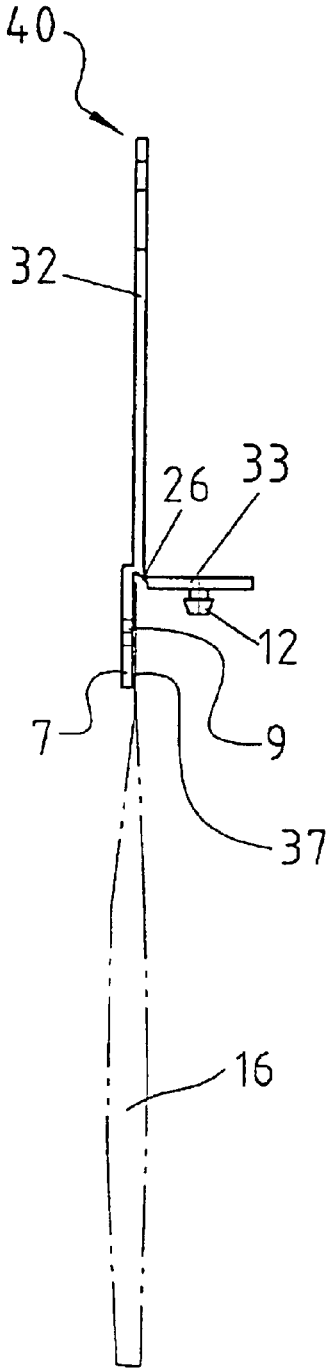

FIG. 12: The side view of the hanger according to FIG. 11.

Figure 13:
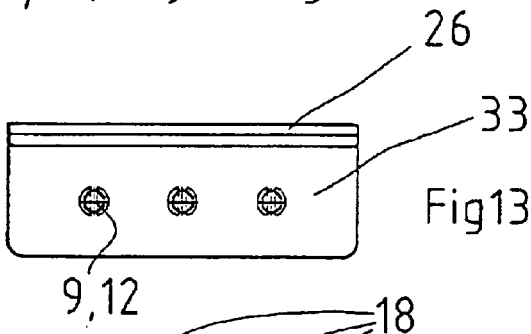

FIG. 13: The top view of the closure region of the hanger according to FIG. 11 in the closed state.

Figure 14:
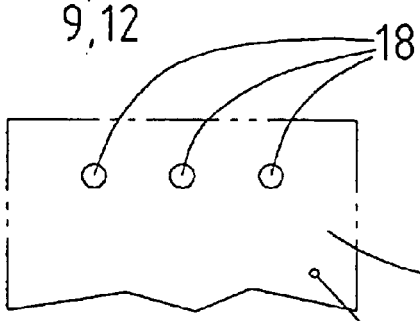
Figure 15:
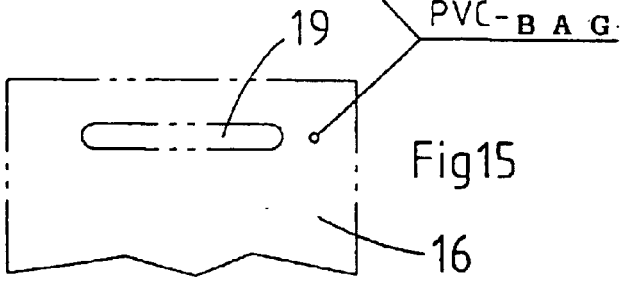

FIGS. 14–15: The different constructions of the plastic bag corresponding to FIGS. 4 and 5 for use with the hanger according to FIGS. 11 to 13.

The hanger 1 according to FIGS. 1 to 3 is preferably made of a plastic material which can be constructed in one or more layers. There is a relatively flat card body 2 in the lower region of which is formed a clamping receptacle for plastic bags 16 to be held.

The clamping receptacle according to FIGS. 1 to 3 consists of a holding strip 11 which is connected on one side by a film hinge 10 to the material of the card body 2 and which in a vertical axis is linked pivotably to the side edge of the card body.

At the free end of the holding strip 11 is integrally formed a latch strip 13 which in the latched state encompasses the side edge 14 of the card body 2.

In the card body 2 is arranged an upper recess 3 through which a hook passes in a known manner, so that the hanger 1 can be hung on a specific display surface.

Different designs of plastic bags 16 can be clamped in the clamping gap between the inside of the holding strip 11 and the associated fastening surface 7 on the card body 2, but also thinner plastic bags.

In the general description it has already been pointed out that in particular the support of plastic bags is achieved in a very simple manner by the fact that a plastic bag with an upper closure bead which protrudes beyond the edge 8 of the fastening surface 7 is used, so that on closure of the holding strip 11 the closure bead lies above the edge 8. Hence the plastic bag 16 is prevented from sliding down.

In the description below, the support of a plastic bag 16 is described. For reasons of simplification the support of a thinner plastic bag is not shown in more detail, although this support can be constructed the same.

In the embodiment shown, however, further support means for the plastic bag 16 are provided.

Here, on the inside of the holding strip are integrally formed latch pins 12 which correspond to associated recesses 9 in the card body 2.

In the top portion 17 and opening region of the plastic bag 16 according to FIG. 4 there are associated recesses 18 which correspond to the latch pins 12.

On closure of the holding strip 11 (the latter is pivoted in arrow direction 35 about the film hinge 10), therefore, the latch pins 12 pass through the recesses 18 of the plastic bag 16 and the latter is additionally held in the clamping gap between holding strip 11 and fastening surface 7.

A particular advantage arises when the fastening surface 7 recedes from the front side 4 of the card body, so that when the holding strip 11 is closed according to FIG. 2 the card body 2 forms a continuous plane surface.

On this surface can now according to FIG. 2 be stuck a label 6 which also overlaps the region of the holding strip 11, so that on opening the holding strip 11 the label 6 must be damaged.

To the label 6 on the front 4 are in this case applied suitable indications of the type and quality of the merchandise packed in the plastic bag 16.

The back 5 of the card body 2 can bear an inscription in addition.

Also the label can be stuck simultaneously on the front and back.

Instead of the individual adjacent recesses 18 in the plastic bag 16, according to FIG. 5 there can be used an elongate recess 19 which cooperates with a corresponding elongate latch knob on the inside of the holding strip 11.

FIGS. 6 to 8 show another embodiment of a hanger 20 in which the same reference numbers have been used for the same components. Here the holding strip 21 is joined in a horizontal pivot axis by a film hinge 26 to the material of the card body 22, and on the inside of the holding strip 21 are here provided mandrels 24 which, when the holding strip is latched to the side edges of the card body 22, penetrate the material of the plastic bag 16 and hold it. As an extra means of protection for a plastic bag designed with a closure bead it may also be provided that in the region of the fastening surface 7 of the card body 22 is arranged a transverse groove 27 which in the embodiment shown is formed integrally in the card body 22 itself. Instead of the transverse groove 27, an open slot passing through the card body can be used.

In a manner known in the art, the closure of a plastic bag 16 of this kind consists of a closure bead 28 which is pressed into an associated closure groove 29.

The named parts 28, 29 are now laid in the transverse groove 27 and the holding strip 21 is closed in arrow direction 26, so that firstly the mandrels 24 pass through the material of the plastic bag and secondly the transverse groove 27 is closed, as shown in FIG. 8.

It is self-evident that, instead of the mandrels 24 shown here, the latch means 9, 12 according to the embodiment of FIGS. 1 to 3 can be used.

Latching of the holding strip 21 is effected here by two latch strips 23 which are each mounted laterally on the holding strip and which each snap-fit with the side edges 14 of the card body 22.

The mandrels 24 then moreover engage in recesses 25 in the card body 22. The kinematic reversal in which the mandrels are arranged in the region of the fastening surface 7 on the card body 22 and the associated recesses are provided in the holding strip 21 is of course possible too.

Similarly it is not necessary to the solution that the transverse groove 27 is made in the region of the back 5 of the card body 22.

The above construction does of course have the advantage that by this means again a continuous plane surface is achieved on the front 4 of the card body 22, which can in turn have a label 6 stuck over its whole area. But it may also be provided that the transverse groove is arranged both in the card body and in the holding strip or only in the holding strip alone. But the transverse groove can always be replaced by a slot.

In FIGS. 9 and 10 is shown a further embodiment of a hanger 30 showing a holding strip 31 which is arranged on the card body 34 so as to be pivotable about a horizontal axis in the film hinge 26, latching of the holding strip 31 being accomplished with the latch strips 23 in the same way as illustrated in FIGS. 6 and 7. As a simplified embodiment compared with FIGS. 6 and 7 it is shown that only one transverse groove 27 is formed on the back of the card body 34, and that support of the plastic bag is effected only in the region of the transverse groove and the adjoining clamping gap 37.

Such simple support is particularly suitable for the support of plastic bags with transversely extending closure seam 28, 29.

In FIGS. 11 to 13 as a further embodiment of a hanger 40 is shown a card body in which again a holding strip 33 is linked to the card body in a film hinge 26 so as to be pivotable about a horizontal axis.

Support of the plastic bag is here effected by the latch means 9, 12 which have already been described with the aid of FIGS. 1 to 3.

In addition the plastic strip is also held in the clamping gap 37 between card body and holding strip 33.

This embodiment shows, in comparison with FIGS. 1 to 3, that the holding strip can be linked to the card body so as to be pivotable both in a horizontal axis and in a vertical axis.

The invention is not confined only to the support of plastic bags in which is packed corresponding merchandise to be displayed.

It may also be provided that the merchandise itself is held on the card body by the receiving means described above with the aid of all embodiments, in combination with the holding strips described.

LEGEND TO DRAWINGS

1 hanger
2 card body
3 recess
4 front
5 back
6 label
7 fastening surface
8 edge
9 recess
10 film hinge
11 holding strip
12 latch pin
13 latch strip
14 side edge
16 plastic bag
17 top portion
18 recess
19 recess
20 hanger
21 holding strip
22 card body
23 latch strip
24 mandrel
25 recess
26 film hinge
27 transverse groove
28 closure bead
29 closure groove
30 hanger
31 holding strip
32 card body
33 holding strip
34 card body
35 arrow direction
36 arrow direction
37 clamping gap
38
39
40 hanger

What is claimed is:

1. A hanger that maintains a bag therein, said bag having an upper edge with a closure bead along said upper edge, said hanger comprising:

a card body having at least one recess, said card body defining one side with a first portion of said one side defining a flat surface and a second portion of said one side defining a fastening surface that is recessed from the flat surface of the first portion of said one side, said fastening surface defining a transverse groove therein;

at least one holding strip; and at least one film hinge, each film hinge corresponding to a respective one of each of said holding strips and pivotally connecting the corresponding holding strip to said card body, each of said holding strips cooperating with the transverse groove of said card body at times when said holding strip is pivoted adjacent to said card body to define a transverse cavity between the holding strip and the fastening surface of the card body, said transverse cavity receiving the closure bead of the bag at times when the bag is maintained in the hanger.

2. A hanger that maintains a bag therein, said bag having an upper edge with a closure bead along said upper edge, said hanger comprising:

a card body having at least one recess, said card body defining one side with a first portion of said one side defining a flat surface and another portion of said one side defining a fastening surface that is recessed from the flat surface of the first portion of said one side, said fastening surface defining a transverse groove therein;

at least one holding strip; and at least one film hinge, each film hinge corresponding to a respective one of each of said holding strips and pivotally connecting the corresponding holding strip to said card body, each of said holding strips cooperating with the transverse groove of said card body at times when said holding strip is pivoted adjacent to said card body with;

(a) one side of the holding strip defining a transverse cavity between the holding strip and the fastening surface of the card body, said transverse cavity receiving the closure bead of the bag at times when the bag is maintained in the hanger, and (b) the opposite side of the holding strip cooperating with the flat surface of said first portion of the card body to form a continuous plane surface that can receive a label.

3. A hanger that maintains a bag therein, said bag having an upper edge with a closure bead along said upper edge, said hanger comprising:

a card body having at least one recess, said card body defining one side with a first portion of said one side defining a flat surface and a second portion of said one side defining a fastening surface that is recessed from the flat surface of the first portion of said one side;

at least one holding strip, said holding strip having a surface that defines a transverse groove therein; and at least one film hinge, each film hinge corresponding to a respective one of each of said holding strips and pivotally connecting the corresponding holding strip to said card body, the transverse groove of each of said holding strips cooperating with said card body at times when said holding strip is pivoted adjacent to said card body to define a transverse cavity between the holding strip and the fastening surface of the card body, said transverse cavity receiving the closure bead of the bag at times when the bag is maintained in the hanger.

4. The hanger of claim 3 wherein the hanger further includes a means for latching the holding strip in a closed position adjacent to the card body.

5. The hanger of claim 4 wherein the means for latching the holding strip releasably latches the holding strip to the fastening surface of the card body.

6. The hanger of claim 4 wherein the means for latching the holding strip permanently latches the holding strip to the fastening surface of the card body.

7. The hanger of claim 4 wherein said card body further includes a side edge and wherein the means for latching engages the side edge of the card body.

8. The hanger of claim 4 wherein the means for latching extends through the bag that is maintained between the holding strip and the card body.

9. The hanger of claim 8 wherein the means for latching comprises mandrels that are connected to the holding strip.

10. The hanger of claim 8 wherein the means for latching comprises mandrels that are connected to the card body.

11. The hanger of claim 1 or 3 wherein said card body has a major edge and a minor edge and where said holding strip is oriented substantially parallel to the major edge of said card body.

12. The hanger of claim 1 or 3 wherein said card body has a major edge and a minor edge and wherein said holding strip is oriented substantially parallel to the minor edge of said card body.

13. The hanger of claim 1 or 3 wherein said film hinge is oriented in a substantially vertical position.

14. The hanger of claim 1 or 3 wherein said film hinge is oriented in a substantially horizontal position.

15. A hanger that maintains a bag therein, said bag having an upper edge with a closure bead along said upper edge, said hanger comprising:

a card body having at least one recess, said card body defining one side with a first portion of said one side defining a flat surface and another portion of said one side defining a fastening surface that is recessed from the flat surface of the first portion of said one side;

at least one holding strip, said holding strip having one side that defines a transverse groove therein; and at least one film hinge, each film hinge corresponding to a respective one of each of said holding strips and pivotally connecting the corresponding holding strip to said card body, the transverse groove of each of said holding strips cooperating with said card body at times when said holding strip is pivoted adjacent to said card body with;

(a) the transverse groove of the holding strip defining a transverse cavity between the holding strip and the fastening surface of the card body, said transverse cavity receiving the closure bead of the bag at times when the bag is maintained in the hanger, and (b) the side of the holding strip that is opposite from said one side cooperating with the flat surface of said first portion of the card body to form a continuous plane surface that can receive a label.

16. The hanger of claim 2 or 15 wherein the hanger further includes a means for latching the holding strip in a closed position adjacent to the card body.

17. The hanger of claim 16 wherein the means for latching the holding strip releasably latches the holding strip to the fastening surface of the card body.

18. The hanger of claim 16 wherein the means for latching the holding strip permanently latches the holding strip to the fastening surface of the card body.

19. The hanger of claim 16 wherein said card body further includes a side edge and wherein the means for latching engages the side edge of the card body.

20. The hanger of claim 16 wherein the means for latching extends through the bag that is maintained between the holding strip and the card body.

21. The hanger of claim 20 wherein the means for latching comprises mandrels that are connected to the holding strip.

22. The hanger of claim 20 wherein the means for latching comprises mandrels that are connected to the card body.

23. The hanger of claim 2 or 15 wherein said card body has a major edge and a minor edge and where said holding strip is oriented substantially parallel to the major edge of said card body.

24. The hanger of claim 2 or 15 wherein said card body has a major edge and a minor edge and wherein said holding strip is oriented substantially parallel to the minor edge of said card body.

25. The hanger of claim 2 or 15 wherein said film hinge is oriented in a substantially vertical position.

26. The hanger of claim 2 or 15 wherein said film hinge is oriented in a substantially horizontal position.

* * * * *